US009750973B1

(12) United States Patent
Yang

(10) Patent No.: US 9,750,973 B1
(45) Date of Patent: Sep. 5, 2017

(54) HUMAN HAND-CRAWLING AND FOOT-BOUNDING APPARATUS

(71) Applicant: Weipeng Yang, Houston, TX (US)

(72) Inventor: Weipeng Yang, Houston, TX (US)

( * ) Notice: Subject to any disclaimer, the term of this patent is extended or adjusted under 35 U.S.C. 154(b) by 0 days.

(21) Appl. No.: 15/238,387

(22) Filed: Aug. 16, 2016

Related U.S. Application Data

(60) Provisional application No. 62/282,937, filed on Aug. 17, 2015, provisional application No. 62/386,960, filed on Dec. 18, 2015.

(51) Int. Cl.

| | |
|---|---|
| ***A63B 22/00*** | (2006.01) |
| ***A63B 71/00*** | (2006.01) |
| ***A63B 23/035*** | (2006.01) |
| ***A61H 3/02*** | (2006.01) |
| ***A63B 21/00*** | (2006.01) |
| *A63B 21/02* | (2006.01) |
| *A63B 25/02* | (2006.01) |
| *A63B 25/00* | (2006.01) |

(52) U.S. Cl.
CPC ..... *A63B 23/0355* (2013.01); *A61H 3/0277* (2013.01); *A61H 3/0288* (2013.01); *A63B 21/0004* (2013.01); *A63B 21/4015* (2015.10); *A63B 21/4019* (2015.10); *A63B 21/4027* (2015.10); *A63B 21/023* (2013.01); *A63B 23/035* (2013.01); *A63B 25/00* (2013.01); *A63B 25/02* (2013.01)

(58) Field of Classification Search
CPC ..... A63B 23/0355; A63B 21/4027; A63B 21/4019; A63B 21/4015; A63B 25/00; A63B 25/02; A63B 25/06; A63B 25/10; A63B 21/00004; A63B 21/00058; A63B 21/00061; A63B 21/00189; A63B 21/023; A63B 21/025; A63B 21/4035; A63B 2022/0035; A63B 23/035; A63B 23/12; A63B 25/08; A63B 21/0407; A63B 21/0428; A61H 3/0288; A61H 3/0277
USPC ..... 446/26; 472/135
See application file for complete search history.

(56) References Cited

U.S. PATENT DOCUMENTS

| | | | | |
|---|---|---|---|---|
| 3,174,494 | A | 3/1965 | Maguire, Jr. | |
| 3,992,023 | A | 11/1976 | Moorer | |
| 4,688,789 | A | 8/1987 | Alter | |
| 5,038,811 | A | 8/1991 | Gilmore | |
| 5,458,143 | A | 10/1995 | Herr | |
| 5,571,065 | A | 11/1996 | Buitoni | |
| 6,080,087 | A | 6/2000 | Bingham | |
| 6,440,045 | B1 | 8/2002 | Gaston | |
| 7,686,025 | B1 * | 3/2010 | Dowling | A45B 9/04 135/66 |
| 7,823,599 | B2 * | 11/2010 | Thibodeau | A45B 9/04 135/84 |

(Continued)

*Primary Examiner* — Joshua Lee
*Assistant Examiner* — Megan Anderson
(74) *Attorney, Agent, or Firm* — Gordon G. Waggett, P.C.

(57) ABSTRACT

Height-adjustable apparatus using a spring to urge forward and rearward undulating whippy locomotion. A hand-crawling embodiment enables users to engage in all-fours crawling locomotion while the body is conventionally situated in a two-legged orientation. A foot-bounding embodiment enables walkers, joggers, runners and jumpers to engage in forward and backward whippy locomotion. A crutch embodiment enables crippled or injured users to likewise engage in whippy locomotion.

17 Claims, 13 Drawing Sheets

(56) References Cited

U.S. PATENT DOCUMENTS

| | | | | |
|---|---|---|---|---|
| 7,950,975 | B1 * | 5/2011 | Chapman, Jr. | A63J 7/005 16/430 |
| 7,998,043 | B2 | 8/2011 | Zhou et al. | |
| 2002/0083616 | A1 * | 7/2002 | Hajianpour | A43B 13/182 36/7.8 |
| 2006/0211545 | A1 * | 9/2006 | Smyer | A63B 25/00 482/75 |
| 2012/0244998 | A1 | 9/2012 | Rao | |
| 2013/0123082 | A1 * | 5/2013 | Bashraheel | A63B 21/068 482/141 |

* cited by examiner

HUMAN HAND-CRAWLING AND FOOT-BOUNDING APPARATUS

RELATED APPLICATIONS

This application claims priority based upon U.S. Provisional Application Ser. No. 62/282,937 filed Aug. 17, 2015 and Ser. No. 62/386,960 filed Dec. 18, 2015, both of which are incorporated herein by reference.

FIELD OF THE INVENTION

The present invention generally relates to an apparatus for a user to engage in physical exercise, and more particularly relates to an apparatus that enables a user to simultaneously exercise both arms and both legs while crawling on all-fours according to a unique bounding exercise protocol.

BACKGROUND OF THE INVENTION

There have been myriad attempts to improve physical exercise and fitness routines to promote an individual's good health and well-being. On a regularly recurring basis, television screens are saturated with infomercials and the like advertising sure-to-succeed exercise and dance routines seemingly guaranteed to develop for the television-viewer a sound body and healthy physique, not to mention to expedite weight reduction and other health benefits. But, there has been significantly less emphasis upon providing low-impact, essentially stress-free exercises and the like targeted for use by injured or handicapped or otherwise crippled personnel or senior citizens or even the elderly. Indeed, generally, rehabilitation and exercise routines have typically been the exclusive bailiwick of professional therapists and the health-care professionals.

Nevertheless, there have been attempts to improve the state of the art for promoting such disadvantaged individuals' good health and well-being. For instance, in U.S. Pat. No. 3,174,494, Maguire discloses a contoured crutch which has a hand grip contoured to receive the heel of the hand. Positioned upwardly from the rear of the hand grip is a concave or hollowed-out arm receiving section which continues up to a little bit above the elbow of the user, or may be of just sufficient length to receive part of the forearm. A body support, shaped somewhat like the conventional under-arm or armpit grip, but curved to fit more comfortably against the side of the body as well as in the armpit, forms the top portion of the crutch and is situated just slightly above the top portion of the arm support. The hand grip has a rear portion which is somewhat flattened and of an enlarged area, and which is contoured to receive the heel of the user's hand, and has a slightly convex contoured portion to fit into the palm of the hand, while the fingers may be lapped around the forward portion of the hand grip and the other edge indented a concavity to comfortably fit the grasping thumb. The curved arm support extending up from the heel of the hand receives the forearm and the elbow and the lower portion of the upper arm to be supported and maintained thereby. At the same time this arm support, behind the forearm and elbow, does not completely capture these parts, so that the individual using the crutch is not deprived of complete freedom of movement of the arm into other positions if necessary or intended.

As another example, Gilmore, in U.S. Pat. No. 5,038,811, discloses overcoming a long-standing deficiency of spring-tension crutch cuffs and also cuffs tend to be loose-fitting to facilitate insertion of forearms thereinto but fail to grip the forearm with sufficient firmness to assure stability. A cylindrically-curved cuff pivotally connected to joinder member by a pivot pin/bolt; joinder member configured with pair of orthogonal angularly-spaced side arms. The cylinder is split and grooved at approximately 15° from a lug, thereby forming a narrow thin hinge section. This split and hinge divide the cylindrical cuff strap into a larger section that is fixed with respect to lug and a smaller movable section that is pivoted for enabling swinging movement toward and away from the free end thereof. This configuration is essential so that the larger fixed section overhangs the forearm of the user so that the crutch remains hanging from the forearm, even though the smaller section is wide open, while at the same time the opening provided is sufficiently wide to allow the forearm to be removed sideways from the cuff.

Still another crutch-based improvement in the art was disclosed by Herr in U.S. Pat. No. 5,458,143 in which a crutch having an elbow spring and shank spring permits maximum locomotion efficiency by a user for maneuvering over flat surfaces, up and down steps, and up and down hills. It attaches to user's arm wherein elastic springs absorb the energy of impact of the crutch with a surface and then releases this energy to propel the user upwards and forwards. The Herr Crutch also has springs for storing energy when the elbow flexes and releases energy to assist elbow extension, thereby enabling the user to invoke both elbow muscle flexors and extensors to ascend stairways and hills. This invention demonstrates how springs can be used in a crutch to maximize cushioning, stability, and efficiency.

Bingham, in U.S. Pat. No. 6,080,087, discloses an apparatus to assist a developmentally-delayed child assume various postural and ambulatory positions including oblique or horizontal crawling all-fours or quadruped positions. Straps are connected proximal to a child's rear hip and height-adjustment is readily achieved in order to hold the child at a predetermined height, thereby enabling the child to move down to a hand-and-knee weight-bearing crawling position or up therefrom in a non-weight-bearing, suspended position from above. Embodiments can also be used for disabled adults. The straps are strategically emplaced upon a user's shoulder areas and interconnected with an axially slidable adjustable damping member that limits the "bounce" invoked as incentive to trigger controlled creeping or quadruped movement Buitoni, in U.S. Pat. No. 5,571,065, teaches extending the reach of a user's forearms for equalizing the hip-to-foot distance and shoulder-to-forearm extension distance. The rear dorsal portion of a user's hand grasps a brace in the forward direction and elbow-end of his forearm is grasped by an arm-embracer, and at least a portion of the wrist-end of the forearm contacts a forearm support at its forward-facing surface. With this brace being connected to a post, the brace-post combination is slidably engaged and coupled by a shock-absorbing coupling. The outer end of the post terminates in a foot that, when contacting the ground, enables the brace-post combination to rotate about an axis perpendicular to the forward direction. Accordingly, the foot may be hinged to the post, interconnected to the post with a flat spring, or have a lower cylindrical surface—having along axis parallel to the axis of rotation. The shock-absorbing coupling reduces impulse transmitted to the user's writ and shoulder as the user's foot strikes the ground.

In U.S. Pat. No. 4,688,789, Alter discloses pair of arm braces that enable walking or running movement on all fours that simultaneously exercises arms and legs absent any back stress, which is commonly experienced during conventional locomotion in a vertical orientation—on two feet of course—absent squatting. These relatively short braces are grasped akin to crutches wherein the back dorsal portion of the user's hands are facing outwards, perpendicular to direction of movement. This orientation appears to be counterproductive to facilitating users' all-fours stride-length (similar to that of a four-legged animal). Lengths of its support member and U-shaped member are selected wherein the arm brace compensates for different length of a user's arms and legs. Similarly, in U.S. Pat. No. 7,998,043, Zhou et al. disclose a prone crawling dual-track exercise apparatus that simulates a four-limbed animal's crawling-based locomotion; and in U.S. Pat. No. 3,352,356, Lillibridge discloses a creeping device for assisting physically and mentally retarded users perform creeping-based exercises.

Accordingly, while limited progress has been made for enabling physically or mentally challenged individuals to engage in regular exercise routines to promote health and wellness, what is needed in the art is an apparatus that effectively enables users of virtually all physical and mental conditions, regardless of whether normal or injured or handicapped or otherwise deficient, to participate in essentially natural crawling-based exercise routines that require minimum balance and stability attributes, and nevertheless afford maximum benefit to be derived from simultaneously implicating both arms and both legs in an all-fours protocol. These limitations and disadvantages of the prior art are overcome with embodiments of the present invention, wherein improved means and techniques are provided which are especially useful for effectuating all-fours exercise routines in which the user has the benefit of invoking an embodiment of the instant hand-crawler glove apparatus that enables exercises to be conducted at a pace commensurate with the user's physical and mental capabilities and athletic prowess, while inherently avoiding undue impact or stress upon the user's anatomy and intertwined joints and musculature. The prior art appears to be devoid of any convenient and sufficiently portable apparatus that reliably enables a user to engage in challenging all-fours crawling exercises as contemplated herein.

SUMMARY OF THE INVENTION

The present invention teaches a hand-crawling apparatus that enables a user to engage in all-fours crawling locomotion rather than engaging in walking, jogging and/or running while the body is conventionally situated in a substantially two-legged vertical orientation inherently associated with strain on the back, joints and implicated anatomical structures. More particularly, embodiments of the present invention facilitate users of virtually all levels of physical and mental health and wellness to effectively engage in all-fours crawling exercises associated with minimal strain on the back, joints and implicated anatomical structures.

The present invention also enables walkers, joggers, runners and even jumpers to engage in unique forward and backward locomotion while essentially positioned erect on two feet or alternatively while using one or two crutches to effectuate such locomotion.

Embodiments of the present invention comprise a unique apparatus that enables even a user plagued with an imbalance condition or suffering from a temporary or permanent physical disability to engage in challenging physical exercise that inherently minimizes the demands and stress associated with physical exercise, by enabling such a user to simultaneously exercise both arms and legs while uniquely crawling on all-fours at varying rates of speed depending upon user-physical capability.

Hand-crawler glove embodiments taught herein are configured for each of a user's hands to be easily inserted thereinto, with each hand disposed within a respective hand-crawler glove affixed to a substantially horizontal hand-platform. This hand-platform is preferably disposed substantially parallel to a spaced-apart cushioned layered base member having a vertical threaded post member disposed therebetween. The hand-platform and base member are flexibly joined by a combination of a spring member disposed circumferentially of the post member and within a housing, in one embodiment hereof, in conjunction with an arcuate flexible brace member disposed at one end of the base member. Once the user's hands are inserted into each of a pair of hand-crawler gloves and secured thereinto, the user engages in all-fours crawling under unique upwards and downwards undulating vertical spring-driven motion while synchronously progressing horizontally on the ground in whippy-like locomotion as will be elucidated herein.

In another embodiment hereof, the hand-platform and base member are also flexibly joined by just a spring member disposed circumferentially of the post member and within a suitable housing. As will be appreciated by those skilled in the art, in order for this alternative embodiment to sustain prerequisite stability without unduly compromising contemplated flexibility, the spring should afford suitable compression-expansion characteristics in a manner well known in the art. It is contemplated that embodiments of the present invention would be commercially available in kit-form or package-form having a variety of interchangeable spring members to accommodate users of varying sizes and weights.

In still another embodiment hereof, the stability of the hand-platform may be reinforced by a readily removable stabilizer cylinder that inherently supplements the vertical integrity of the underlying apparatus. As will become apparent to those conversant in the art, incorporating this stabilizer cylinder into the instant hand-crawling glove apparatus has been particularly advantageous for overweight users or adult users suffering from balance limitations.

In yet another embodiment hereof, a spring-based crutch apparatus is disclosed which would be profoundly useful in conjunction with a specially-adapted crutch. As is commonplace in the art, such a specially-adapted crutch or pair of crutches would be adjusted to a user's size attributes and then the threaded pole portion thereof would be screwably inserted into the apparatus taught hereunder to enable the user to benefit from engaging in whippy locomotion as will be hereinafter described.

In another embodiment hereof, a spring-based standing erect locomotion apparatus is disclosed which has been found to be particularly advantageous for such fitness activities as power-walking, jogging, running and even jumping.

It is an object and advantage of embodiments of the present invention to provide a convenient, inexpensive and lightweight portable hand-crawling apparatus that facilitates all-fours crawling locomotion.

It another object of the present invention to provide a hand-crawler apparatus having an interchangeable spring mechanism that urges a user's upper body to intermittently rise and fall vertically in a controlled manner similar to whippy locomotion, as taught herein.

It yet another object of the present invention to provide an apparatus for engaging in all-fours crawling exercise routines at various speeds commensurate with the user's physical and mental capability and athletic prowess, while incurring minimal impact upon the user's anatomy and implicated joints, ligaments and musculature.

It another object of the present invention to provide a spring-based crutch apparatus having an interchangeable spring mechanism that urges a user's upper body to intermittently rise and fall vertically in a controlled manner similar to whippy locomotion, as taught herein.

These and other objects and advantages of the present invention will become apparent from the following specification and accompanying drawings.

DETAILED DESCRIPTION

Figure 1:
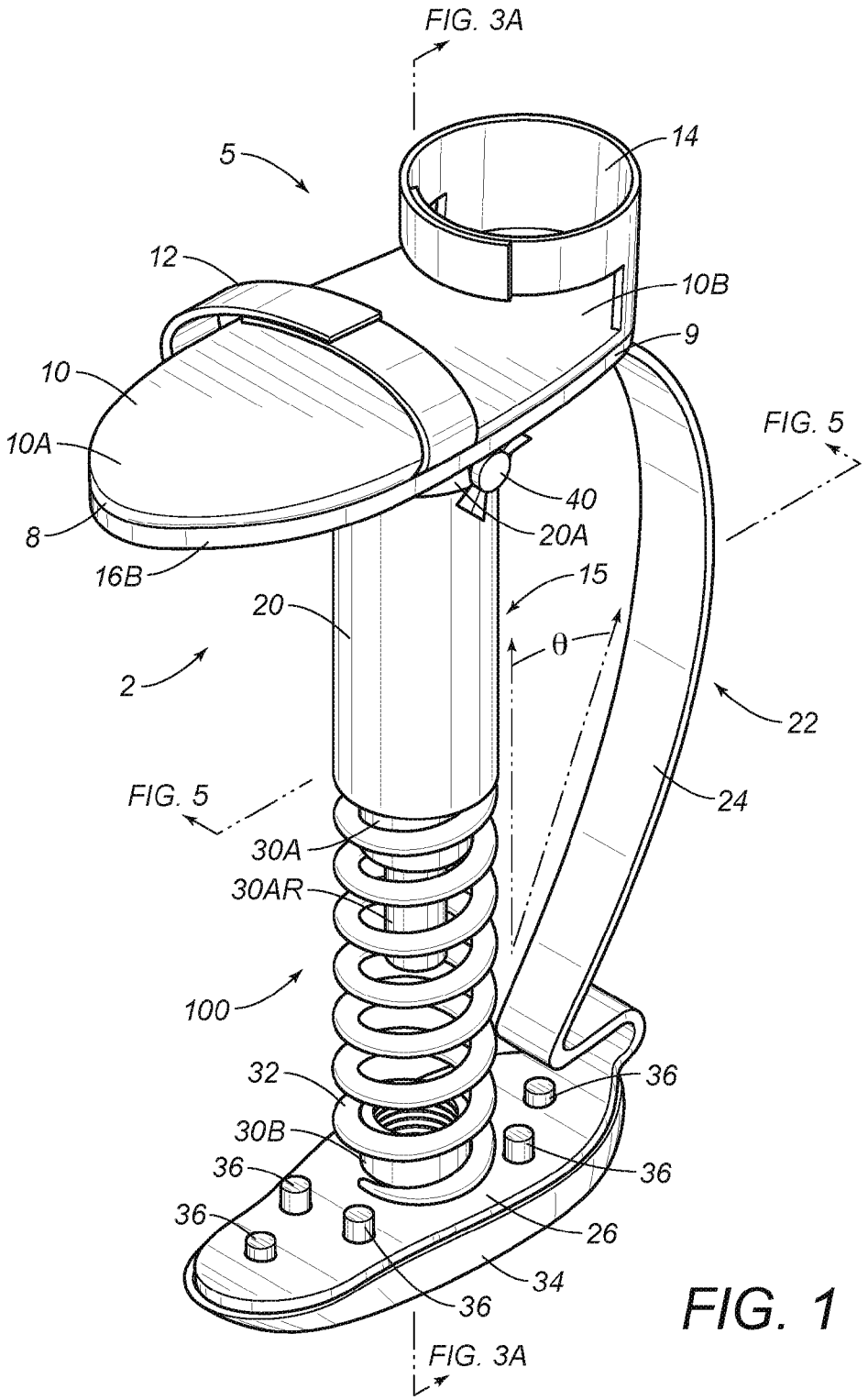
FIG. 1 depicts a frontal perspective view of a spiral-driven hand-crawler embodiment of the present invention with a flat zonal arcuate brace member, having two supporting-points on the bottom of the base.

Reference is made herein to the figures in the accompanying drawings in which like numerals refer to like components. Referring collectively to FIGS. 1-22B, there are depicted various views of nine alternative representative human hand-crawler glove embodiments of the present invention as will be hereinafter described. For instance, spiral-driven hand-crawler glove embodiment 2 is depicted in perspective frontal views in FIGS. 1, and 11, respectively; and depicted in corresponding exploded views in FIGS. 2 and 12, respectively. Similarly, representative spiral-driven crutch embodiment 42 of the present invention is depicted in simplified frontal perspective views in FIGS. 22A and 22B, respectively.

Thus, exemplary of teachings herein, FIGS. 1-8 depict various views of embodiment 2 and FIGS. 11-18 depict similar views of embodiment 7, each such embodiment providing base assembly 100 comprising a dual supporting combination of a substantially vertical interchangeable spring member 32 and a substantially chamfered variously angulated elastic brace member 22 which cooperatively manifest two contact-points on base member 26. As will become clear to those skilled in the art, the various embodiments taught herein enable a human user engaging in an all-fours exercise or like locomotion to jointly promote contemplated undulating alternating upward and downward unique whippy hand-crawling movement. In particular, there are depicted hand-crawler glove embodiments 2 and 7, respectively, having hand-shoe or hand-glove assembly 5 supported therebeneath by centrally disposed base assembly 100 comprising post assembly 15 and brace assembly 22, with base assembly 100 affixed at one end thereof to hand platform member 10 and affixed at the other, opposite end thereof to base member 26. It will become evident that each of post assembly 15 and brace assembly 22 is affixed at a different contact point upon base member 26.

Figure 19:
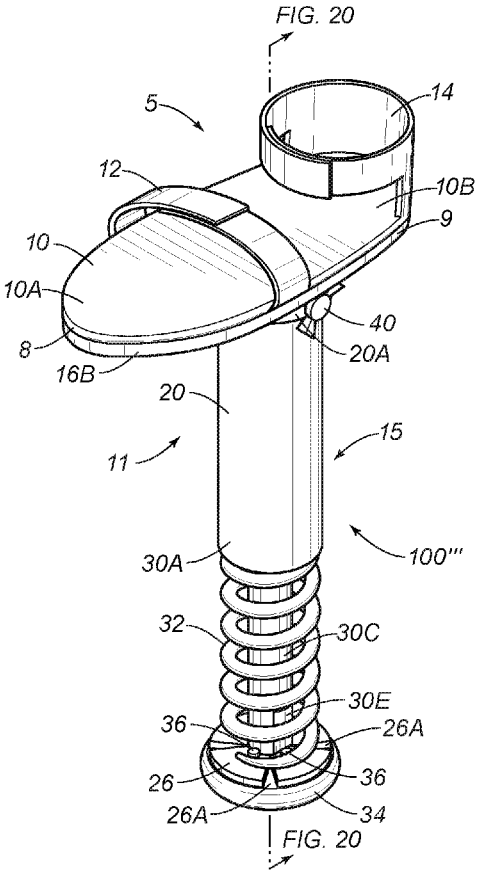
FIG. 19 depicts a frontal perspective view of an alternative spiral-driven hand-crawler embodiment of the present invention, with only one supporting-point on the bottom of the base.
Figure 20:
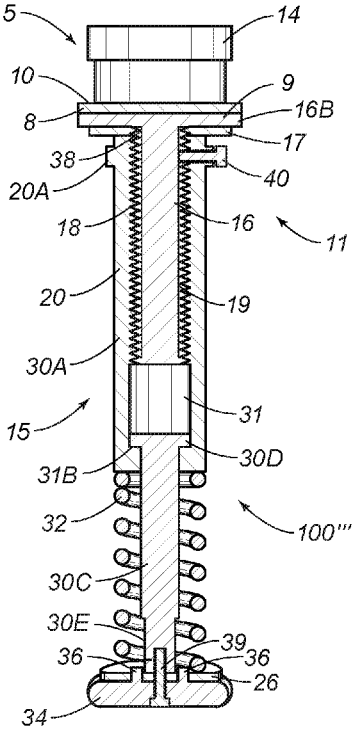
FIG. 20 depicts a frontal cross-sectional view through section line FIG. 20-FIG. 20 depicted in FIG. 19.

Similarly, FIGS. 19-21 depict various views of embodiment 11 providing a single support feature wherein there is included a substantially vertical interchangeable spring member 32 which manifests a single contact-point on base member 26 to promote the undulating alternating upward and downward whippy locomotion inherent in the unique hand-crawling movement taught hereunder.

As will be hereinafter described, these supporting structures enable hand-crawler glove embodiments (alternatively and equivalently referred to as hand-shoe embodiments) to facilitate a user's engaging in alternating bounding and rebounding substantially vertically from the ground beneath the user's crawler-gloved hands, while simultaneously being propelled in a forward direction along the ground. More particularly, it will become evident to those skilled in the art that crawling locomotion contemplated hereunder enables a user to effectuate movement substantially linear and parallel to the ground via a specially orchestrated crawling hand-jumping locomotion manifest by intermittently bounding and rebounding substantially vertically, while simultaneously and synchronously progressing horizontally either in a forward or a backward direction characterized herein as a "whippy" motion pattern.

Figure 2:
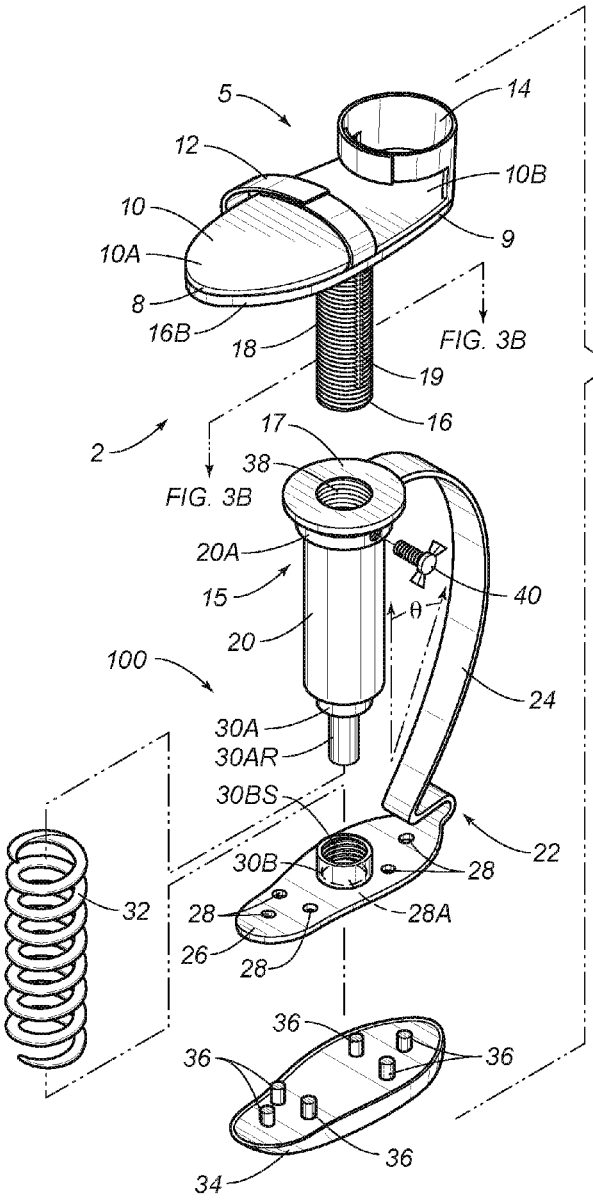
FIG. 2 depicts an exploded perspective view of the embodiment depicted in FIG. 1.

As illustrated in FIGS. 1 and 2, post assembly 15 comprises post member 16 projecting perpendicularly from and downwardly of hand-platform 10, and is disposed centrally within housing member 20 and screwably adjoins hand-shoe glove assembly 5 and base assembly 100 as will be hereinafter described. Base assembly 100 comprises cylindrical housing member 20 disposed at an end thereof proximal to hand-platform 10 and, at the other opposite end thereof, proximal to spring member 32. It will be seen that spring member 32 is disposed immediately below cylindrical housing member 20. Housing member 20 circumscribes the upper portion of post member 16 and is fixedly attached at its upper end to ring member 20A and at its lower end to upper spring retainer member 30A, respectively. As clearly depicted, spring member 32 is disposed in a substantially vertical orientation between upper or top spring retainer member 30A and lower or bottom spring retainer member 30B.

Housing member 20 together with threaded post member 16 enable vertical movement of hand platform 10, which is preferably constructed from rigid metal or sufficiently strong nonmetal materials well known in the art. To assure integrity of the underlying support structure of embodiments hereof, housing member 20 and brace member 24 should preferably be adjoined into an integrated structure, comprising metal and nonmetal materials, via conventional fasteners such as nuts and the like. It should be evident to those skilled in the art that welds would be a viable option for securely adjoining adjacent metal components.

Lower spring retainer member 30B is fixedly attached to substantially horizontal base plate member 26 interconnected with preferably skid-resistant elastomeric sole member 34 therebelow via plurality of layered stud members 36 fixedly attached thereto and projecting upwardly to be inserted through corresponding plurality of stud hole members 28 contained upon the top surface of base plate member 26. As well known in the art, each of these stud members is secured after passing through a corresponding stud hole member disposed thereupon by a suitably-sized nut member (not shown).

Those skilled in the art will appreciate that the unique crawling movement contemplated hereunder and enabled by embodiments of the present invention, exemplified in FIGS. 1-6 but not limited to this configuration, is a consequence of the cooperation manifest by spring member 32 and inherently flexible brace member 24. It will be understood that spring member 32 should preferably be interchangeable, being selected to impart prerequisite compressibility for accommodating a user or prescribed set of users characterized by a particular size range and weight range. The instant structure herein described enables such a selected spring member to be conveniently positioned by being inserted between upper spring retainer member 30A and lower spring retainer member 30B, and to expeditiously replace spring member 32 in situ to achieve appropriate compression-and-decompression behavior, respectively, as a function of user-attributes.

It will be understood that, to also accommodate a user's physical attributes, the height of post or column member 15 should preferably be adjusted by screwably rotating post member 16 under the influence of its corresponding thread members 18 into mated whorl hole 38 to arrive at a length thereof commensurate with, i.e., functionally proportional to, the user's height. As shown, each thread member 18 of post assembly 15 has a pair of groove members 19 symmetrically disposed thereupon. Set of wing-nuts or like fastener members 40 would then be engaged through like set of threaded holes disposed in ring member 20A with corresponding pairs of groove members 19 to enable the user to securely adjust height-positioning of hand platform 10. The present invention contemplates that, in order to achieve the prescribed prerequisite alternating upwards and downwards undulating motion taught herein, a suitably sized spring member or a pneumatically-controlled cylinder or a hydraulically-controlled cylinder or the like, may be implemented without deviating from the purposes disclosed herein.

Thus, a user would select a suitably configured spring member 32 from a set of spring members and install the selected spring member between first spring retainer member 30A and second spring retainer member 30B. Next, the user's height would be accommodated by the user rotating hand-platform 10 about threaded post member 16 to adjust hand-platform 10 to be aligned with brace support member 24 and simultaneously affixing its set vertical position by tightening a fastener member 40, exemplified herein as a bolt, to securely engage pair of groove members 19. Such adjustments to embodiments hereof limit vertical movement of hand-platform 10 and promote level rotation thereof, found to be essential for sustaining stability of a user's body at a reasonable bounding height range during crawling movement as contemplated hereunder. It should be appreciated that, once set to be compatible with a user's physical attributes, the user would emplace each hand, respectively, into hand-embracing member 5 configured as a hand-sheath—effectively functioning as a hand-shoe substantially enclosing each user's hand. Indeed, once the user's hands are emplaced therewithin, each of the pair of hand-glove members would be tightened akin to lacing or strapping a pair of shoes.

It should be understood that materials of construction of the hand-embracing hand-shoe member contemplated hereunder are essentially the same as or similar to materials of construction commonly used in the shoe manufacturing industry. As will be readily appreciated by those skilled in the art, rigid threaded post member 16 would typically be molded from suitable hard nonmetallic, plastic material or metallic material. Of course, when post member 16 is constructed from metal or in combination with metallic materials, welding or the like would be a preferred method of joinder thereof with hand platform member 10.

Focusing collectively on FIGS. 1-2, 3A-3B, and 4-6, it should be evident that support afforded by centrally disposed post member 16 is augmented by brace support member 24 disposed at one end of hand-crawler glove platform 10 and fixedly attached thereto, to provide adequate support therefor and concomitant stability thereto. More particularly, brace assembly 22 comprises an elastomeric sufficiently firm arcuate and inherently flexible brace support member 24 affixed at one end thereof to hand platform 10 and to base plate member 26 at the other, opposite end. It has been found advantageous to configure the arc described by arcuate brace member 24 having angle θ. It will be seen that arcuate angle θ has been found to function as contemplated hereunder when in the range of about 95° to about 135° to afford prerequisite compromise of stability and flexion under the influence of the intermittent upward and downward user hand-triggered whippy motion urged by compression and expansion, respectively, of spring member 32 as the user proceeds to walk or run at various speeds on the ground all fours, i.e., essentially simultaneously using both hands and both feet.

As illustrated in FIGS. 1-6. hand-crawler platform 10 comprises two embracing members 5 for securing a user's hand to this hand-crawler platform. It should be evident to those conversant in the art, that to enable a user to efficiently crawl using all-fours as disclosed herein, pairs of hand-crawler glove assemblies 5 taught hereunder are required. Thus, each user's hand, in turn, is secured prior to engaging in crawling exercises: first hand-embracing member 12 and second hand-embracing member 14—of hand-crawler assembly 5—secure a user's hands thereinto. In particular, first hand-embracing member 12 is affixed to the front portion 10A of hand platform 10 for embracing—by strapping or like securement—the user's fingers thereto. Similarly, second hand-embracing member 14 is affixed to the rear portion 10B of hand platform 10 for embracing—by strapping or the like—the user's hand-heel and wrist adjacent thereto.

In a manner well known in the art, first hand-embracing member 12, exemplified as a strap member, and second hand-embracing member 14, also exemplified as a strap member, are secured at each respective open end by Velcro or the like to prevent the user's hands from inadvertently being dislodged from hand-crawler glove apparatus 2 during active locomotion therewith. It will be appreciated that embracing heel portion of the hand in combination with the wrist tends to prevent undue lateral wrist movement which would be detrimental to the contemplated forward or rearward locomotion taught herein. During the novel whippy forward or backward locomotion taught by the present invention, base member 26 of a corresponding hand-crawler apparatus 2 engulfing a user's left and right hand, in turn, sustains contact with the ground immediately below. As will be readily understood by those skilled in the art, this attachment may be achieved in any number of ways, including adhesion via Velcro or other commonly used suitable fastening means.

As will become evident to those skilled in the art, the present invention contemplates that embodiments of the instant hand-crawler glove apparatus 2 should be constructed with suitable materials commensurate with providing a user sufficient shock-absorption characteristics to enable various all-fours exercises to be conducted without adverse effects upon the user's back, hands, fingers, forearms, and other implicated joints and musculature that might jeopardize a user's physical well-being, but, indeed, would tend to promote healthful benefits such as weight-reduction and physical fitness. For instance, the upper surface of hand platform 10 should preferably be relatively soft to promote comfort and avoid injury to the plethora of bones, ligaments and muscles that constitute a user's hands. Accordingly, it has been found to be advantageous to construct embodiments of the present invention with a hand platform having a cork surface or with a soft gel liner commonly used for shoe repair or for shoe rebuilding.

Figure 9:
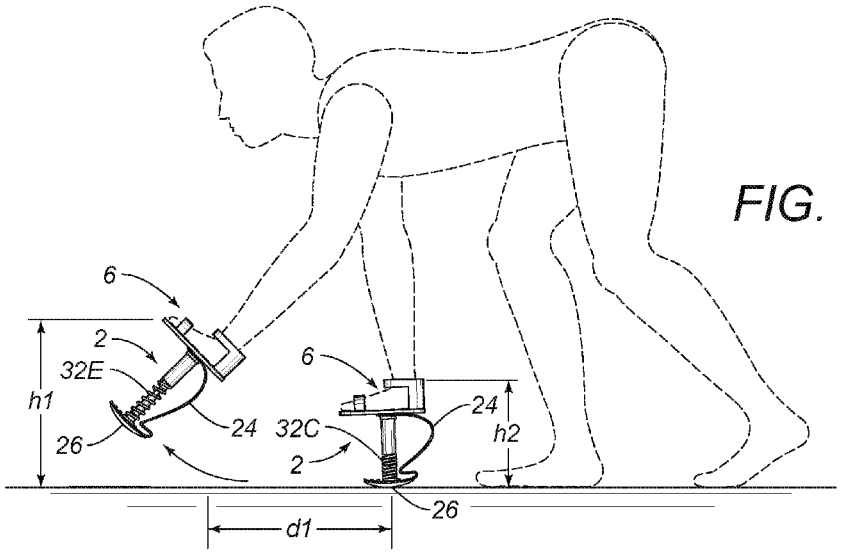
FIG. 9 depicts a simplified side perspective view of a user crawling with the embodiment depicted in FIG. 1.
Figure 10:
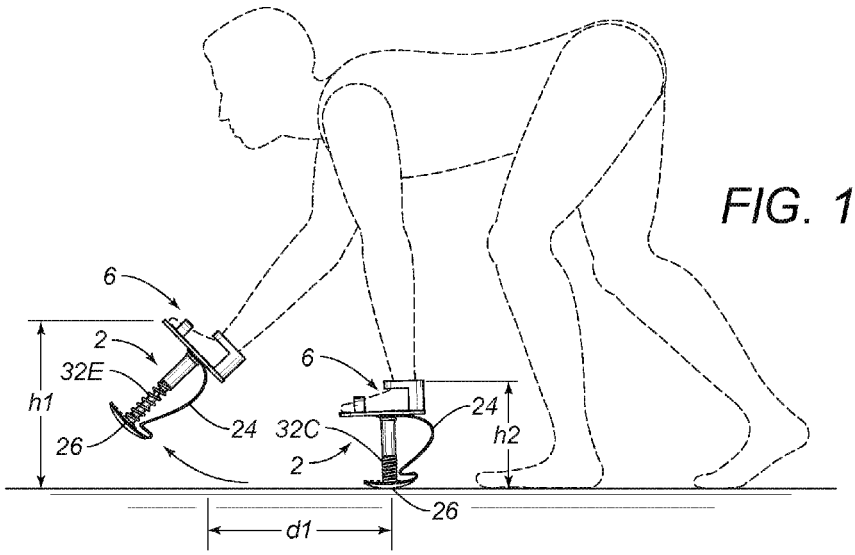
FIG. 10 depicts a simplified side perspective view of a user crawling with the embodiment depicted in FIG. 1, in a crawling position sequentially-related to the position depicted in FIG. 9.

The simplified perspective side views depicted in FIGS. 9 and 10 demonstrate the efficacy of a pair of lightweight but sturdy hand-crawler glove members used to bring crawling exercise to levels of performance heretofore unattainable and, indeed, not even contemplated by practitioners in the art. First, referring to FIG. 9, there is depicted a user having hand-crawler glove apparatus 2 releasably attached to each of his hands, leading forward locomotion with his left hand which is being propelled in an upward direction by user lifting his left and thereby urging spring 32 to its uncompressed or expanded configuration 32E with hand-crawler glove 5 securely but releasably enclosing his left hand situated in combination within left hand-crawler glove 6, while a user's self-generated downward force on his right hand urges spring 32 into compressed configuration 32C with hand-crawler glove 5 securely but releasably enclosing his right hand situated in combination within right hand-crawler glove 6.

Numeral 6 represents a user's securely-embraced hand within an implicated hand-crawler glove assembly 5. Depending upon the sequential placement of each user's hand upon the ground, one hand—the leading hand—is urged upwardly by the pressure imposed by spring 32 as it transforms from being a formerly-compressed spring 32C into a now-expanded, uncompressed spring 32E within a first combination 6 thereof. Simultaneously, the other hand—the trailing hand—is disposed in a diametrically opposite configuration and is urged downwardly by the user's self-imposed force communicated through his implicated arm and contiguous hand upon the hand-crawler glove apparatus, thereby compressing spring 32 from expanded, uncompressed configuration 32E into compressed configuration 32C within a second combination 6 thereof.

Ergo, next, as illustrated by the user's left-and-right hand configuration depicted in FIG. 10, immediately following user's opposite left-and-right hand configuration in FIG. 9, the user's leading forward locomotion is now alternated to his right hand which is being propelled in an upward direction by the release of spring 32 urged to its uncompressed, expanded configuration 32E with hand-crawler glove 5 securely but releasably embracing his right hand situated in combination within right hand-crawler glove 6, while self-generated downward force on his left hand urges spring 32 into compressed configuration 32C with hand-crawler glove 5 securely but releasably embracing his left hand situated in combination within left hand-crawler glove 6. The whippy movement enabled by embodiments of the present invention is characterized by each hand respectively traversing distances d1 and d2 and the hand-crawler moving vertically through heights h1 and h2, as shown. It should be understood by those conversant in the art that, for a user traversing typical distances along the ground at varying pace according to such user's physical attributes and athletic condition and associated prowess, particular distances d1 and d2 vary according to normal stride lengths. It will also be understood that typical vertical heights contemplated to be manifest during use of all-fours hand-crawler embodiments of the present invention should preferably range from about ¼ inch to about ½ inch.

Figure 7:
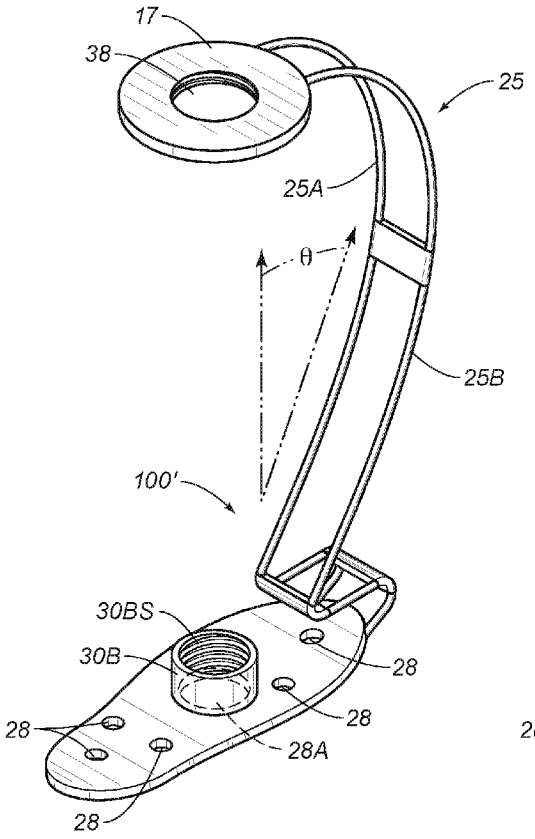
FIG. 7 depicts a frontal partial perspective view of the embodiment depicted in FIGS. 1 and 2, with a pair of rods forming an arcuate brace member.
Figure 8:
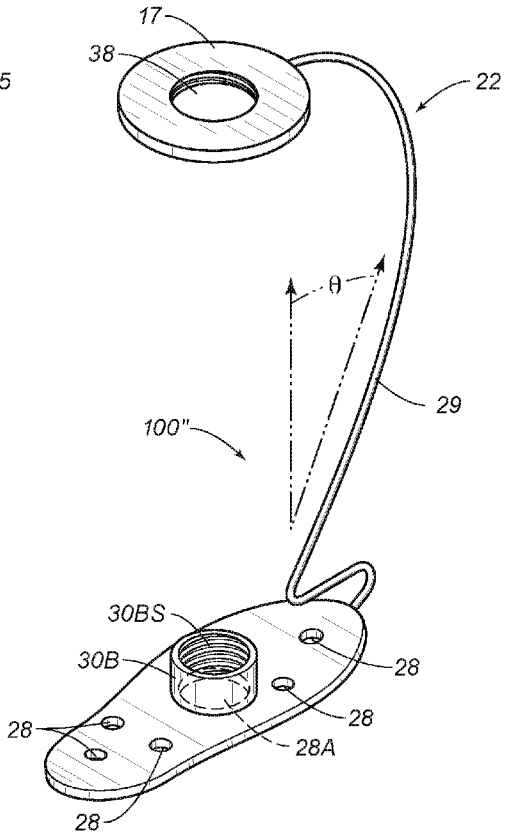
FIG. 8 depicts a frontal perspective view of the embodiment depicted in FIG. 7, with a single rod forming an arcuate brace member.

As illustrated in FIG. 7, it will also be appreciated by those conversant in the art that another embodiment of the present invention (numeral 2 depicted in FIGS. 1-6 and hereinbefore described) could be similarly configured—but with base assembly 100' comprising dual substantially congruent arcuate cylindrical rod supporting brace members 25A-B rather than just one zonal, solid brace member 24 as depicted in FIGS. 1 and 2. It will be further appreciated that FIG. 8 depicts another embodiment of the present invention with base assembly 100" comprising only one cylindrical flexible steel arcuate rod member 29 or the like typically affords more flex than both alternative arcuate brace embodiments depicted in FIGS. 1 and 7, respectively. It will be understood that a tough sufficiently flexible plastic rod member may be used in the embodiments depicted in FIGS. 7 and 8 of the present invention providing the performance contemplated hereunder is achieved.

FIGS. 19, 20, 21A and 21B depict hand-crawler glove embodiment 11 having hand-shoe assembly 5 supported therebeneath by centrally disposed post assembly 15 affixed centrally of hand platform member 10 and affixed centrally at the other, opposite end thereof to base plate member 26. As will be hereinafter described, this supporting structure enables hand-crawler glove embodiments to facilitate a user's engaging in alternating bounding and rebounding substantially vertically from the ground beneath the user's specially-gloved hands, while simultaneously being propelled forward. More particularly, it will become evident to those skilled in the art that crawling locomotion contemplated hereunder enables a user to effectuate linear movement substantially parallel to the ground via specially enabled and orchestrated crawling hand-jumping locomotion characterized by intermittently bounding and rebounding substantially vertically—essentially while synchronously progressing horizontally either in a forward or a backward direction characterized herein as whippy locomotion.

Figure 3B:
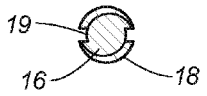
FIG. 3B depicts a cross-sectional plan view through section line FIG. 3B-FIG. 3B of the embodiment depicted in FIG. 2.
Figure 3A:
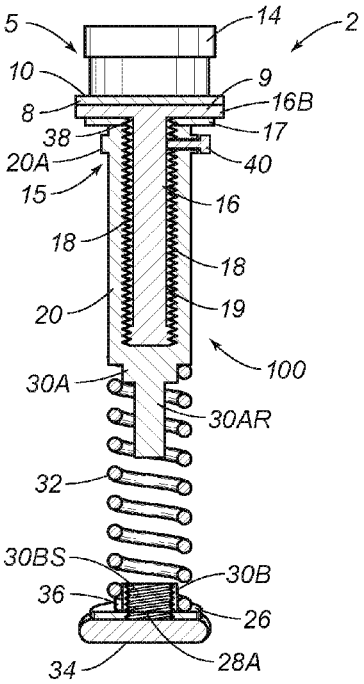
FIG. 3A depicts a frontal cross-sectional view through section line FIG. 3A-FIG. 3A depicted in FIG. 1.
Figure 5:
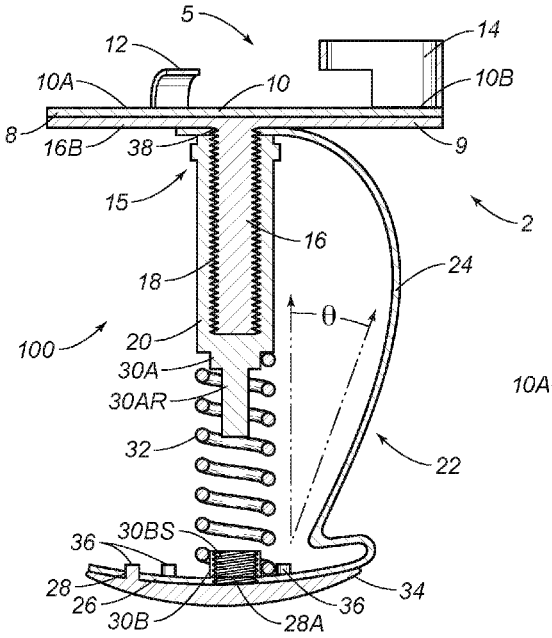
FIG. 5 depicts a cross-sectional side view through section line FIG. 5-FIG. 5 of the embodiment depicted in FIG. 1.
Figure 4:
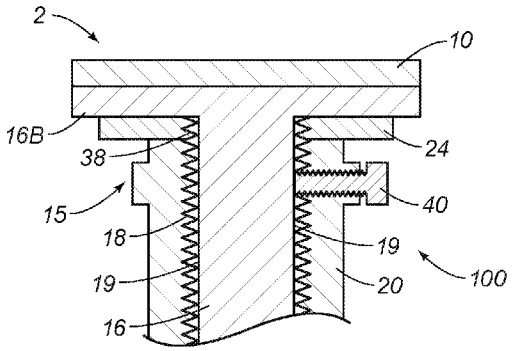
FIG. 4 depicts a cross-sectional detail view depicting the upper portion of the embodiment depicted in FIG. 3A.
Figure 6:
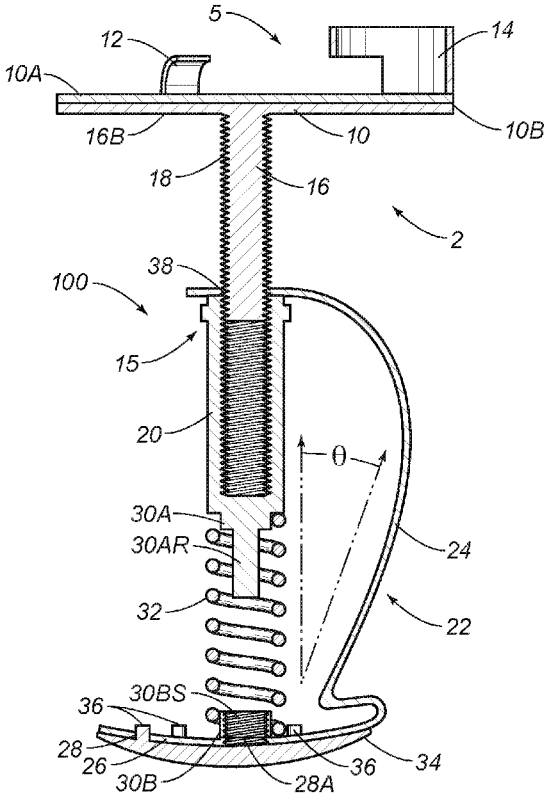
FIG. 6 depicts cross-sectional side view of the embodiment depicted in FIG. 5, with hand platform post member partially downwardly displaced compressing the spring member.
Figure 21A:
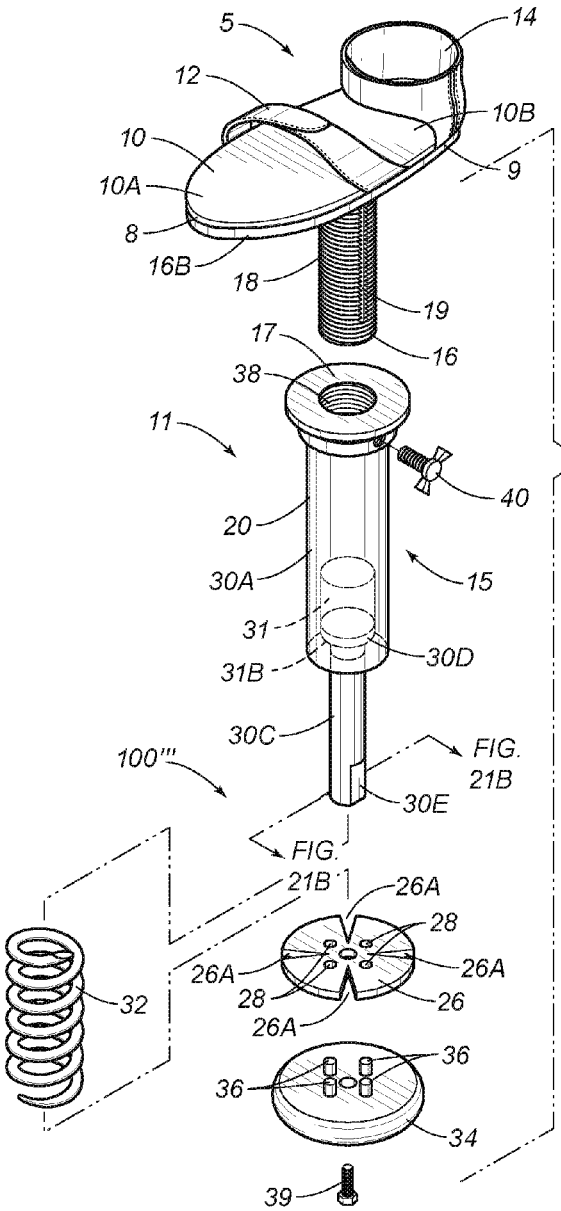
FIG. 21A depicts an exploded perspective view of the embodiment depicted in FIG. 20.

More particularly, FIGS. 19 and 20 depict a frontal perspective view of an alternative spiral-driven hand-crawler embodiment of the present invention similar to the frontal perspective views of the embodiment depicted in FIGS. 1, 2 and 3A, but with base assembly 100'" comprising only one supporting-point on the bottom of base member 26. Similarly, FIG. 21A depicts an exploded perspective view of the embodiment depicted in FIG. 19, in a manner similar to the exploded view depicted in FIG. 2. It will be appreciated that hand-crawler embodiment 11 depicted in FIGS. 19, 20 and 21A differs from hand-crawler embodiment 2 by the absence of brace assembly, 22, 25, 22, respectively, which, among other functions, affords a second point of contact with base member 26.

Thus, those skilled in the art will understand that, instead of benefiting from a second point of contact manifest by a brace assembly as taught herein, the embodiment depicted in FIGS. 19, 20 and 21A will be seen as being somewhat similar to a piston arrangement comprising single spring retainer member 30C affixed to base member 26 at its lower end thereof by a fastener member illustrated as bolt member 39. Base member 26 is preferably configured with a circular cross-section and preferably with plurality of gap members 26A to accommodate elastic distortion of base member 26 manifest during the unique whippy motion herein described. Gap members 26A are preferably configured as wedge-shaped voids cut out of base member 26. It will be seen that plurality of stud members 36 are received through like plurality of apertures 28 disposed upon base member 26.

Figure 21B:
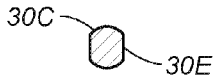
FIG. 21B depicts a cross-sectional left side view through section line FIG. 21B-FIG. 21B of the embodiment depicted in FIG. 21A.

As illustrated in FIG. 21B, it should be appreciated that, to foster stability of post assembly 15 during alternating compression and decompression of spring member 32 as herein described, pair of flat recesses 30E are disposed upon surface of opposing sides of post member 16 to facilitate securely and tightly screwably holding fastener member 39 therewithin. Top portion 30D of spring retainer member 30C is disposed within housing member 20 and has a larger diameter than the lower exposed portion of spring retainer member 30C. Shoulder members 31B are disposed at bottom portion of void space 31 within housing member 20. It will be appreciated that shoulder members 31 function as detents holding top portion 30D of piston-like spring retainer member 30C within housing member 20 to repetitively perform the expansion and compression of spring member 32 as contemplated hereunder.

To achieve the prerequisite functionality taught herein while simultaneously promoting an important lightweight objective, those skilled in the art will understand that spring retainer upper member 30A depicted in FIGS. 1, 2, 3A, 5 and 6 may be constituted with hollow construction besides solid construction. Similarly, top portion 30D of single spring retainer member 30C depicted in FIGS. 19 and 21A may be constituted with hollow construction besides solid construction to achieve the prerequisite functionality taught herein while simultaneously promoting an important lightweight objective. It should be clear to those skilled in the art that the remaining components depicted in FIGS. 19, 20, 21A and 21B are structured and function in the same manner as the like components depicted in FIGS. 1 and 2 and in FIGS. 3A and 3B.

Figure 11:
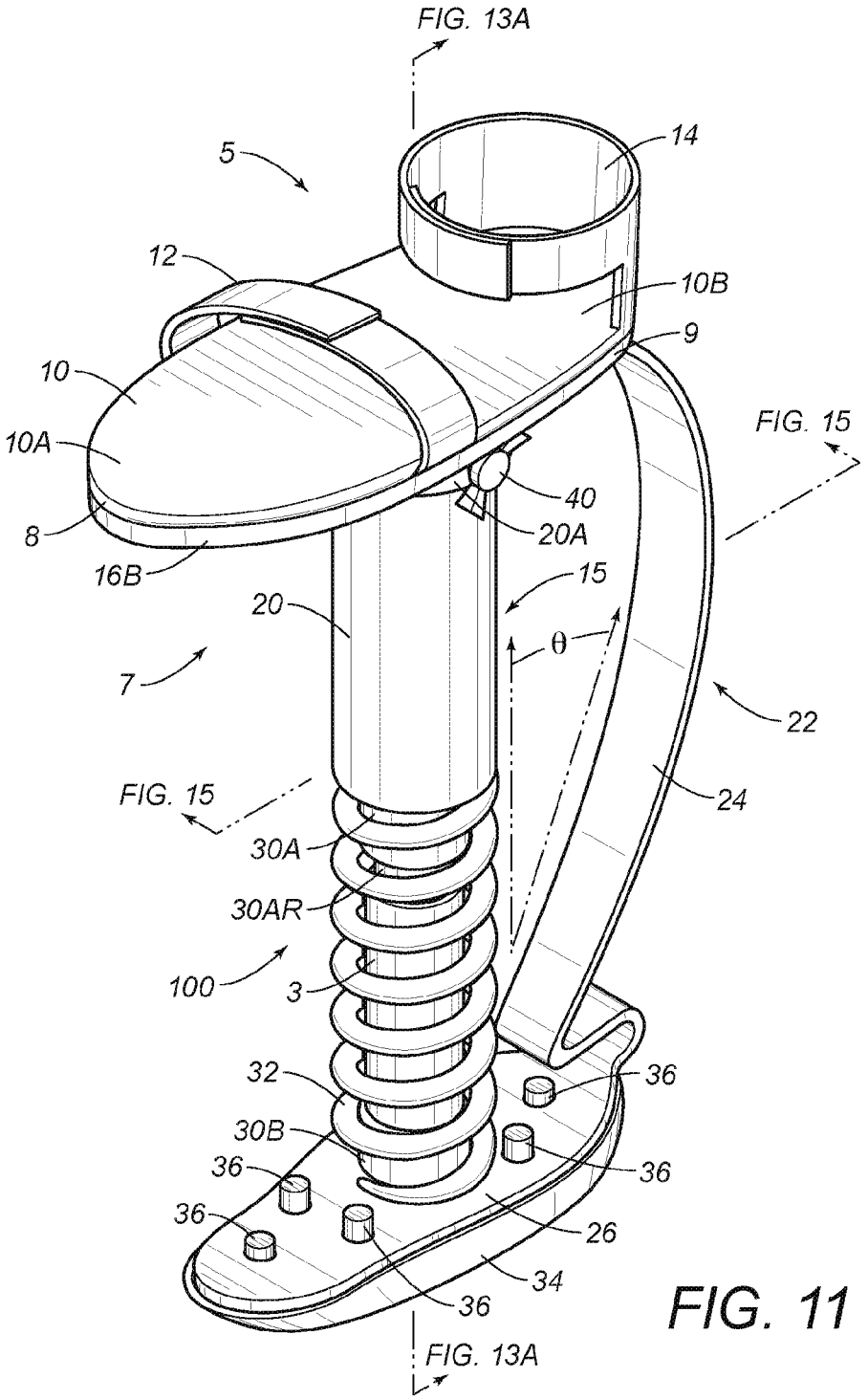
FIG. 11 depicts a frontal perspective view of an alternative spiral-driven hand-crawler embodiment depicted in FIG. 1, reinforced with a stabilizer cylinder of the present invention.
Figure 12:
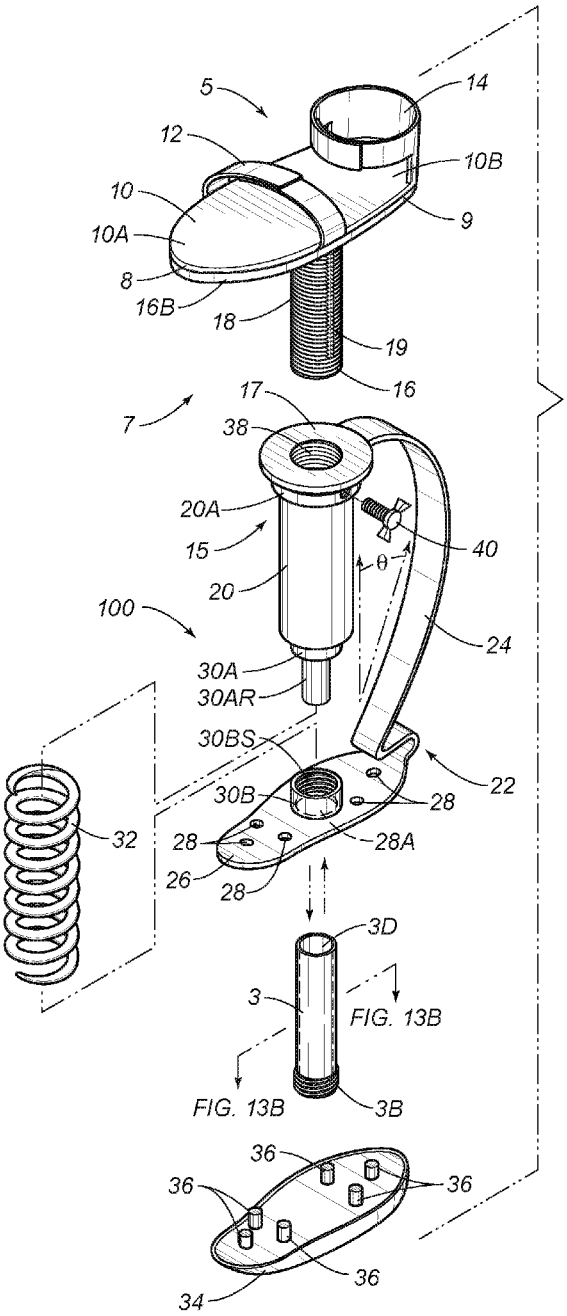
FIG. 12 depicts an exploded perspective view of the embodiment depicted in FIG. 11.

Focusing now on embodiment 7 depicted in FIGS. 11-18, there is depicted specially reinforced embodiment 7 of the embodiment depicted in FIGS. 1-8. By reconciling embodiment 2 with respect to embodiment 7 hereof, it will become evident that both have been configured to receive an optional stability supplemental support cylinder 3 which can be readily inserted through mated hole 28A in base member 26 and likewise readily removed as appropriate for a particular user or particular type of users, will be hereinafter described. FIG. 11 illustrates stabilizer support cylinder 3 in situ circumscribed by cylindrical spring member 32 situated within base assembly 100. The exploded perspective view of embodiment 7 depicted in FIG. 12 illustrates the ease with which stabilizer support cylinder 3 is preferably either screwably emplaced or screwably replaced through hole 28A with cooperation between stability cylinder whorl 3B and internal cylindrical aperture whorl 30BS and secured therein by stability cylinder retainer 30AR. Thus, this stability support cylinder is disposed annularly between post member 16 and spring member 32.

Figure 13B:
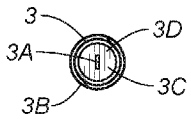
FIG. 13B depicts a cross-sectional plan view through section line FIG. 13B-FIG. 13B of the embodiment depicted in FIG. 12.
Figure 13A:
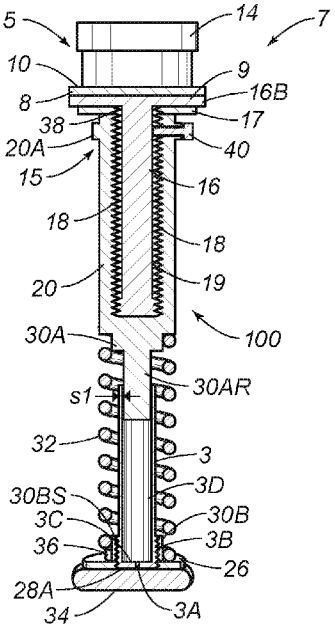
FIG. 13A depicts a frontal cross-sectional view through section line FIG. 13A-FIG. 13A depicted in FIG. 11.
Figure 14:
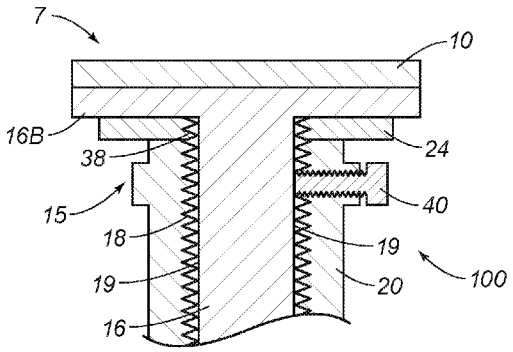
FIG. 14 depicts a cross-sectional detail view depicting the upper portion of the embodiment depicted in FIG. 13A.
Figure 15:
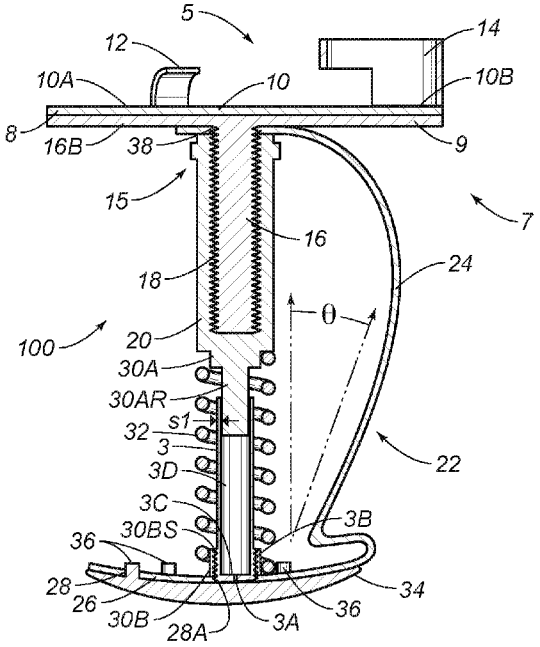
FIG. 15 depicts a cross-sectional side view through section line FIG. 15-FIG. 15 of the embodiment depicted in FIG. 11.
Figure 16:
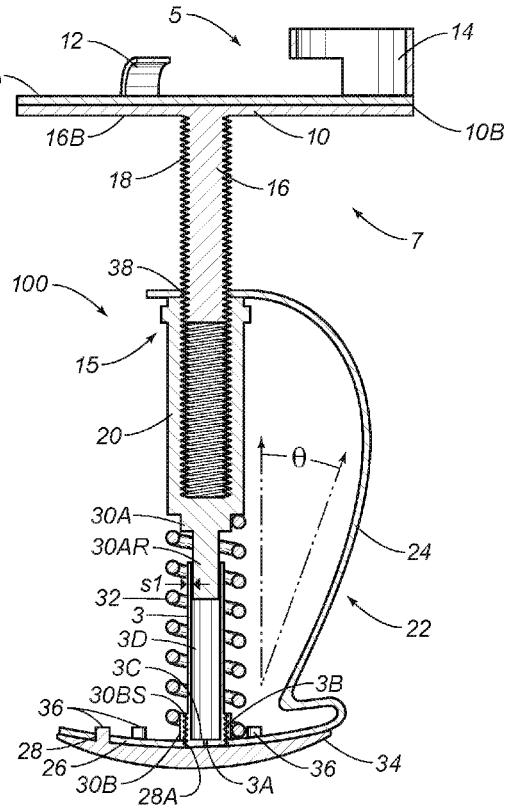
FIG. 16 depicts cross-sectional side view of the embodiment depicted in FIG. 15, with hand platform post member partially downwardly displaced compressing the spring member.
Figure 17:
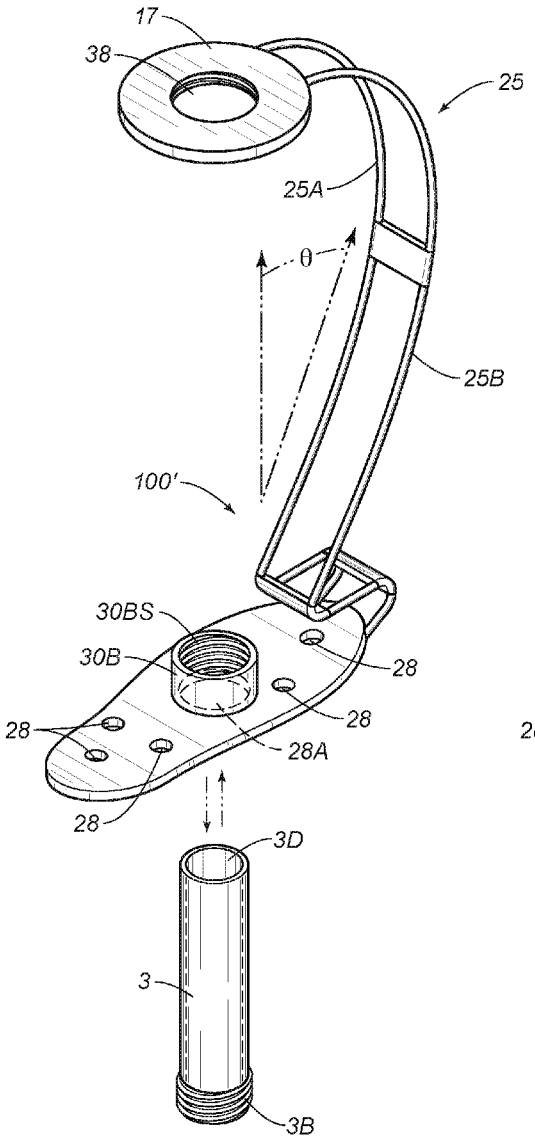
FIG. 17 depicts a frontal partial perspective view of the embodiment depicted in FIGS. 11 and 12, with a pair of rods forming an arcuate brace member, and illustrating insertion and removal of a stabilizer cylinder of the present invention.
Figure 18:
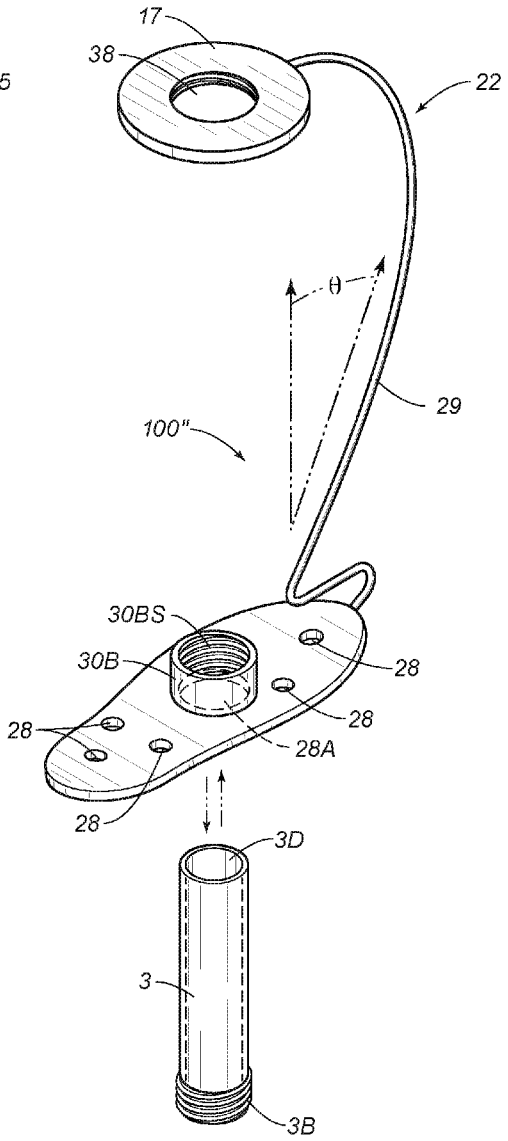
FIG. 18 depicts a frontal perspective view of the embodiment depicted in FIG. 17, with a single rod forming an arcuate brace member.

This attachment and detachment relationship is illustrated in the frontal cross-sectional view in FIG. 13A and the cross-sectional plan view in FIG. 13B. Lower spring retainer member 30B is interconnected with base member 26 either by molding or welding as a function of the material of construction, i.e., either suitable plastic or metal, respectively. It should also be understood that gap s1 between stabilizer cylinder retainer 30AR and bore hole 3D is configured to accommodate moderate horizontal deflection flexibility during whippy locomotion to militate against undermining the crucial stability of embodiments hereof that could jeopardize the user's safety and well-being during whippy locomotion.

Thus, as clearly depicted in FIGS. 12-18, stability cylinder 3 would be optionally emplaced within base assembly 100 of structurally-reinforced embodiment 7 wherein stability cylinder bottom portion 3C is securably attached to base member 26 after being adjusted by a screwdriver having access thereto through slit member 3A in hand platform 10. It should be evident that FIG. 13B illustrates the interrelationship between slit member 3A in stability support cylinder 3 for accommodating insertion of a screwdriver for securing the cylinder bottom 3C to the external threaded whorl 3B.

Figure 22A:
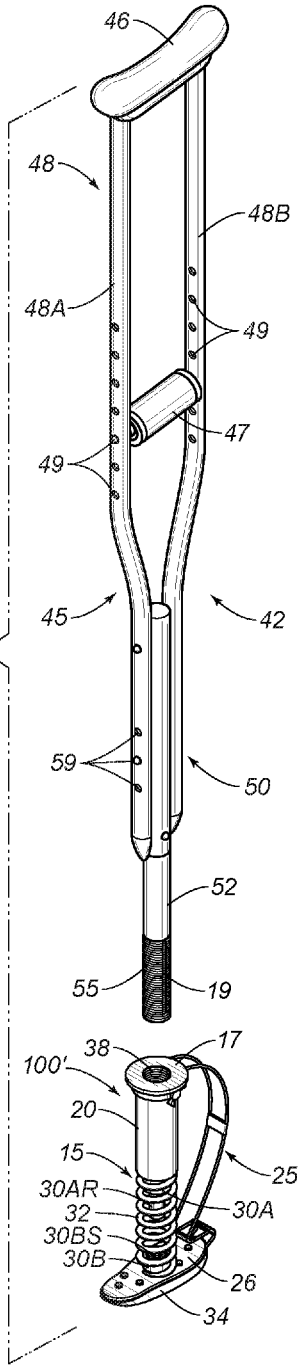
FIG. 22A depicts a frontal partial perspective view of an alternative spiral-driven embodiment of the present invention adapted to accommodate a crutch, and with a pair of rods forming an arcuate brace member.

Now focusing on FIG. 22A, there is seen a frontal perspective view of a dual arcuate brace member embodiment of the present invention 42 comprising base assembly 100' configured to be adjoined with a crutch 45 rather than a user's hand for achieving the novel mode of locomotion taught hereunder. More particularly, as shown, conventional crutch 45 is configured to be screwably received within threaded whorl hole 38 as hereinbefore described. Threads 55 of crutch post member 52 are received by corresponding threads within whorl hole 38. Crutch 45 is shown comprising conventional components well known in the art, including arm pit pad 46 disposed in a transversal relationship with frame 48 constituting first frame portion 48A and second frame portion 48B. Conventional crutch hand grip 47 would be appropriately emplaced within a pair of plurality of symmetrically disposed holes 49 to be commensurate with the user's height. Similarly, crutch post member 52 would be appropriately emplaced in a manner common in the art within a pair of plurality of symmetrically disposed holes to be commensurate with the user's height and other relevant attributes.

It should be understood that, regardless of whether a user walks with a single crutch or with a pair of crutches, crutch embodiment 42 would be adjusted to be compatible with the length of the user's arms (not shown) and the length of the user's legs (not shown). Crutch embodiment 42 comprises frame member 48 having first portion thereof 48A and second portion thereof 48B with horizontal soft hand-grip member 47 disposed as a transversal therebetween. Each of first portion 48A of frame 48 and second portion 48B of frame 48 include two sets of congruent pairs of holes 49 and 59, respectively, along the length thereof as shown. Cushioned hand-grip 47 is situated at an appropriate height by its opposite ends being emplaced in a commensurate pair of holes 49. Similarly, pole member 52 is situated at an appropriate height by its opposite ends being suitably emplaced in a commensurate pair of holes 59. Thus, adjustment of pole member 52 within congruent pairs of holes 59 is functionally related to setting appropriate vertical distance from the bottom adjustable portion 50 of specially-configured crutch member 42 to top portion thereof at pad member 46 would be adjusted by being inserted into a position of post member 52 by emplacing a pair of conventional fasteners (not shown) into identically positioned holes disposed on each of lower portion of corresponding pair of frame portion 48A and 48B. It should be understood that, after these height adjustments have been made to accommodate a user's physical arm and leg physical attributes, threaded portion 55 of pole member 52 of crutch embodiment 42 would be conjoined with base assembly 100' by being screwably emplaced within whirl hole 38 of cylindrical housing member 20, wherein the distance from base member 34 to hand-grip 47 and arm-pit pad 46, respectively, are commensurate with the user's corresponding arm and leg physical attributes. Then, when a user walks with either one or two crutch embodiments hereof, depending upon whether one or two crutches are needed for support and the like, the vertical spring locomotion as hereinbef ore described tends to promote his physical movement along the ground below concomitant with the several benefits hereinbefore elucidated.

Figure 22B:
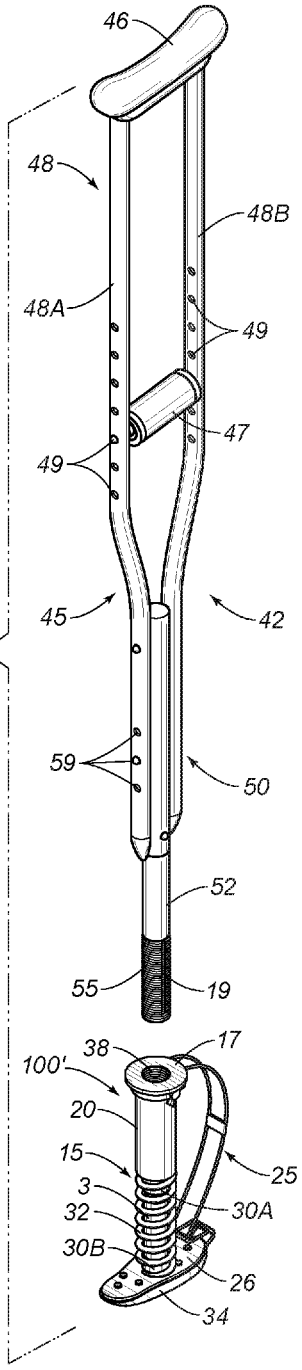
FIG. 22B depicts a frontal partial perspective view of the spiral-driven crutch embodiment depicted in FIG. 22A, reinforced with a stabilizer cylinder of the present invention.

Those skilled in the art will readily appreciate that FIG. 22B corresponds to a frontal perspective view of the dual arcuate brace member embodiment depicted in FIG. 22A, but comprising a supplemental stabilizer support cylinder as hereinbef ore described. Ergo, it will be readily understood that this stabilizer cylinder-reinforced crutch embodiment contemplated hereunder performs with the same feature set and functionality as the unreinforced embodiment thereof depicted in FIG. 22A—but inherently affording substantially greater stability and safety factor than would otherwise be achievable especially under exigent circumstances implicating significantly inhibited crutch-constrained locomotion.

Other variations and modifications will, of course, become apparent from a consideration of the structures and techniques hereinbefore described and depicted. For instance, it has been found that various embodiments of the human hand-crawling and bounding apparatus taught herein may be effectively used with a hand-platform comprising only a front hand-embracing member. That is, it has been found that a user may achieve the whippy locomotion herein described in the absence of such user securing the rear heel hand-portion into a rear hand-embracing member. Indeed, it has been found that, if a user has achieved a sufficient all-fours locomotion level of skill then there may be sufficient equilibrium associated with use of the instant apparatus that supplemental stability provided by a rear hand-embracing member or even a supplemental stability cylinder would not be necessary.

As another example of the versatility of embodiments of the present invention, it has been found to be feasible and, indeed, advantageous not only for users striving to effectuate walking or jogging or running or even jumping exercise routines to sustain physical fitness and good health, but also for athletes and the like to augment normal training protocol by availing themselves of additional thrust and momentum attained by the spring-driven apparatus disclosed herein. Referring collectively to the simplified illustrations depicted in FIGS. 23 and 24, there is seen, similar to the illustrations depicted in FIGS. 9 and 10, a user engaging in a walking sequence while invoking the benefits imparted by the present invention. First, referring to FIG. 23, there is depicted a user having foot-bounding glove apparatus 2' releasably attached to each of his feet, leading forward locomotion with his left foot which is being propelled in an upward direction by user lifting his left and thereby urging spring 32 to its uncompressed or expanded configuration 32E' with the foot-bounding glove securely but releasably enclosing his left foot situated in combination within left foot-bounding glove 6, while a user's self-generated downward force on his right foot urges spring 32' into compressed configuration 32C' with the foot-bounding glove securely but releasably enclosing his right foot situated in combination within right foot-bounding glove 6'.

It should be understood that numeral 6' represents a user's securely-embraced foot within an implicated foot-bounding glove assembly. Depending upon the sequential placement of each user's foot upon the ground, one foot—the leading foot—is urged upwardly by the pressure imposed by spring 32' as it transforms from being a formerly-compressed spring 32C' into a now-expanded, uncompressed spring 32E' within a first combination 6' thereof. Simultaneously, the other foot—the trailing foot—is disposed in a diametrically opposite configuration and is urged downwardly by the user's self-imposed force communicated through his implicated leg and contiguous foot upon the foot-bounding glove apparatus, thereby compressing spring 32' from expanded, uncompressed configuration 32E' into compressed configuration 32C' within a second combination 6' thereof.

Figure 23:
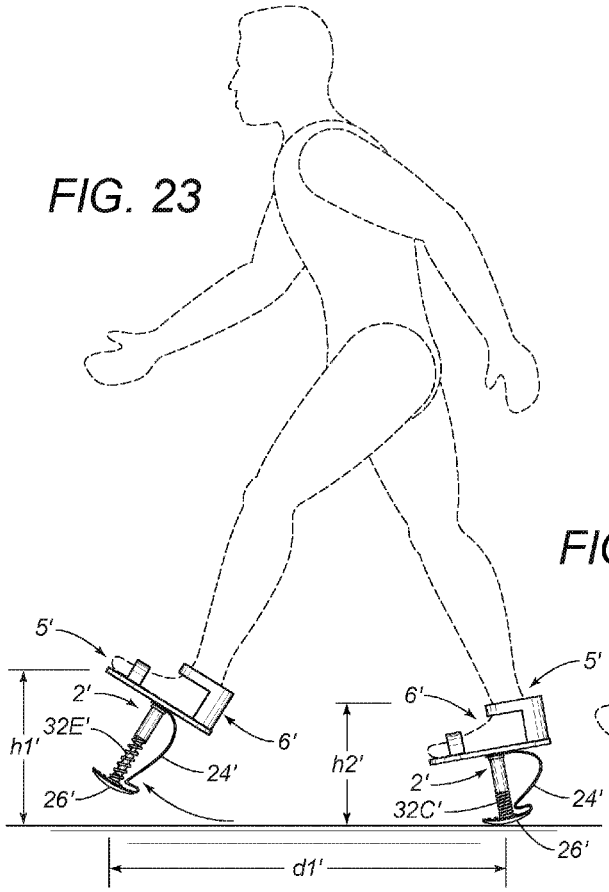
FIG. 23 depicts a simplified side perspective view of a user engaging in power-walking with the embodiment depicted in FIG. 1.
Figure 24:
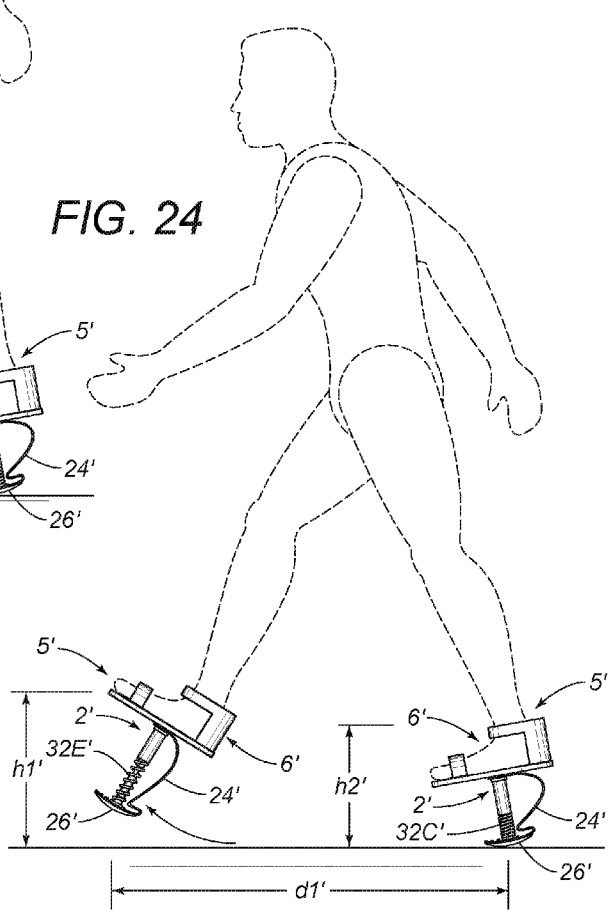
FIG. 24 depicts a simplified side perspective view of a user engaging in power-walking with the embodiment depicted in FIG. 1, in a walking position sequentially-related to the position depicted in FIG. 23.

Ergo, next, as illustrated by the user's left-and-right foot configuration depicted in FIG. 24, immediately following user's opposite left-and-right foot configuration in FIG. 23, the user's leading forward locomotion is now alternated to his right foot which is being propelled in an upward direction by the release of spring 32' urged to its uncompressed, expanded configuration 32E' with foot-bounding glove 5' securely but releasably embracing his right foot situated in combination within right foot-bounding glove 6', while self-generated downward force on his left foot urges spring 32' into compressed configuration 32C' with foot-bounding glove 5' securely but releasably embracing his left foot situated in combination within left foot-bounding glove 6'.

The whippy movement enabled by embodiments of the present invention is characterized by each foot respectively traversing distances d1' and d2' and the foot-bounding apparatus moving vertically through heights h1' and h2', as shown. It should be understood by those conversant in the art that, for a user traversing typical distances along the ground at varying pace according to such user's physical attributes and athletic condition and associated prowess, particular distances d1' and d2' vary according to normal stride lengths. It will also be understood that typical vertical heights contemplated to be manifest during use of pair of foot-bounding embodiments of the present invention should preferably range from about ¼ inch to about ½ inch.

Thus, it will be appreciated by those skilled in the art, that embodiments of the present invention, when invoked by users manifesting sufficient physical skill and exemplary fitness, may achieve astonishing levels of whippy locomotion heretofore thought impossible and, indeed, heretofore not even contemplated.

Accordingly, it should be clearly understood that the present invention is not intended to be limited by the particular features and structures hereinbefore described and depicted in the accompanying drawings, but that the present invention is to be measured by the scope of the appended claims.

The following is a tabulation of the components depicted in the drawings:

COMPONENT LISTING

| Numeral | Component | Explanation |
|---|---|---|
| 2 | Hand-crawler glove apparatus, with either a single flat zonal arcuate brace member or a double rod arcuate brace member | Cylindrical cross-section |
| 3 | Internal stabilizer cylinder member, optional | Support; removable |
| 3A | Slit | Accommodates adjustments by screw driver |
| 3B | Whorl | |
| 3C | Bottom portion | |
| 3D | Bore Hole | |
| 5 | Hand Glove assembly | |
| 6 | Hand-in-glove | User's hand secured within glove apparatus |
| 7 | Hand-crawler glove apparatus, with either a single flat zonal arcuate brace member or a double rod arcuate brace member, and also including optional stabilizer cylinder | Same cylindrical structure as in numeral 2, but reinforced with optional stabilizer cylinder |
| 8 | Top layer of Hand Platform | |
| 9 | Bottom layer of Hand Platform | |
| 10 | Hand Platform | Top surface, for receiving a hand |
| 10A | Front portion | Enclosing fingers of a hand |
| 10B | Rear portion | Enclosing heel of a hand |
| 10C | Sole portion, layered | 2 layers (8 & 9) |
| 11 | Hand-crawler glove apparatus, devoid of arcuate brace member, and also including optional stabilizer cylinder | Piston-like operation |
| 12 | Hand-embracing member, front: fingers | Strap |
| 14 | Hand-embracing member, rear: heel & wrist | dorsal Strap |
| 15 | Post Assembly | |
| 16 | Post member | Threaded |
| 17 | Top portion | |
| 18 | Thread members | |
| 19 | Groove pairs | Symmetrically disposed relative to post |
| 20 | Housing Member | Cylindrical; enclosing Post member 16 |
| 20A | Ring member | Preferably contiguous with top of housing |
| 22 | Brace Assembly | angle θ |
| 24 | Brace Support Member: Zonal, Flat | Arcuate Shoulder Configuration |
| 25 | Brace Support Member, Double | Arcuate Shoulder Configuration |
| 25A, B | Dual Parallel Brace Pair | Alternative configuration, angle θ |
| 26 | Base Member | Bottom Support |
| 26A | Gap member | Accommodates elastic distortion |
| 28 | Apertures for receiving Studs 36 | |
| 28A | Aperture in base member 26 | Through which stabilizer cylinder 3 inserted |
| 29 | Brace Support Member, Single | Arcuate Shoulder Configuration |
| 30A | Spring Retainer, Upper Member | Holding spring within Bracket Assembly, from above |

-continued

| Numeral | Component | Explanation |
|---|---|---|
| 30AR | Internal Stabilizer Cylinder Retainer | |
| 30B | Spring Retainer, Lower Member | Holding spring within Bracket Assembly, from below |
| 30BS | Internal Stabilizer Cylinder whorl | |
| 30C | Single spring retainer member | |
| 30D | Top portion, disposed within housing member 20 | |
| 30E | Recess pair | For tightly retaining screw member 39 against post member 16 |
| 31 | Void within housing 20, below upper threaded portion | |
| 31B | Shoulder members disposed at bottom of void 31, holding top portion 30D of spring retainer 30C | |
| 32 | Spring Member | |
| 34 | Sole Member | Rubberized; Skid Resistant |
| 36 | Stud Member | Insert into corresponding Stud Apertures 28 |
| 38 | Whorl Hole | Centrally & axially disposed within the cylindrical housing & having internal threads mated with post threaded members |
| 39 | Fastener member, connecting lower portion of spring retainer member 30C | Bolt |
| 40 | Set of Securing Fasteners | Bolts or wing-nuts, to adjust height of column |
| 42 | Crutch embodiment | |
| 45 | Crutch | Screwable trunk bottom rather than rubber tip |
| 46 | Pad | Arm pit |
| 47 | Hand-grip | Adjustable height (not shown) |
| 48 | Frame | Holes for adjusting height of hand-grip |
| 48A | Left-side Portion | |
| 48B | Right-side Portion | |
| 49 | Holes to adjust hand-grip height | |
| 50 | Post Support, adjustable | Threaded |
| 52 | Post, threaded | |
| 55 | Threads | |
| 100 or 100' or 100" or 100"' | Base assembly for different embodiments | Lower portion of embodiments, encompassing post assembly (15); housing member (20); spring member (32) & its associated components; base member (26) and its associated components; optionally brace assembly (22) |
| θ | Angle of support relative to vertical | Varies from about 95° to 135° |
| d1, d2 | Horizontal distance traversed by user during first & second cycle | |
| h1, h2 | Elevated height of user's hand after hand-jump | driven by decompressed or expanded spring; about ¼ to ½ inch |
| s1 | Gap between stabilizer cylinder retainer 39AR and bore hole 3D | Accommodates horizontal deflection occurring during whippy motion |

What is claimed is:

1. A hand-crawling apparatus having a pair of hand-crawling members for enabling a user having particular weight and height attributes to engage in whippy locomotion, with each hand-crawling member thereof comprising:

a hand-glove assembly having a planar hand-platform member with a top surface and a bottom surface;

a hand-embracing member affixed to said top surface of said planar hand-platform member;

a cylindrical post assembly affixed at one end thereof to said bottom surface of said hand-platform member having a cylindrical post member projecting perpendicularly therefrom and downwardly thereof, with external threads circumferentially disposed upon said cylindrical post member;

a base assembly comprising a cylindrical housing member with an axially disposed central whorl hole with internal threads sized to mate with said external threads of said cylindrical post member at one end thereof, and threadedly attached to said cylindrical post member; and said base assembly having a replaceable spring member disposed immediately below said cylindrical housing member and secured in a substantially vertical position between a first retainer member affixed thereto at one end of said replaceable spring member and a second retainer member therebelow affixed to a substantially planar base plate member at the other opposite end of said replaceable spring member.

2. The hand-crawling apparatus recited in claim 1, wherein said base assembly has a brace assembly affixed to a top surface of said base plate member at one end thereof spaced apart from said cylindrical post assembly and with an arcuate flexible brace support member adjoined with said cylindrical housing member at a top portion thereof.

3. The hand-crawling apparatus recited in claim 2, wherein said arcuate flexible brace support member is configured with an arc preferably having an angle from 95° to 135° to augment support of said planar hand-platform member and to simultaneously provide sufficient flexion.

4. The hand-crawling apparatus recited in claim 3, wherein said arcuate flexible brace support member comprises a zonal flat configuration.

5. The hand-crawling apparatus recited in claim 3, wherein said arcuate brace support member comprises a double cylindrical parallel configuration.

6. The hand-crawling apparatus recited in claim 3, wherein said base assembly further comprises a removable stabilizer cylinder member screwably inserted thereinto through a whorl hole centrally disposed on the bottom of said base plate member and threadedly mated therewith and secured therein with an internal stabilizer cylinder retainer member, thereby preventing undue lateral movement of said planar hand-platform member.

7. The hand-crawling apparatus recited in claim 1, wherein said base assembly has a plurality of gap members disposed upon said base plate member and circumferentially of said cylindrical post member for accommodating elastic distortion of said base plate member during said whippy locomotion.

8. The hand-crawling apparatus recited in claim 7, wherein each gap member of said plurality of gap members is configured as a wedge shaped void cut out from said base plate member.

9. The hand-crawling apparatus recited in claim 7, wherein pair of flat recess members are disposed upon opposing sides of said cylindrical post member to enable said first spring retainer member to securely retain said replaceable spring member within said cylindrical housing member.

10. The hand-crawling apparatus recited in claim 1, wherein said base plate member is attached substantially in its entirety therebeneath to a skid-resistant elastomeric sole member by a plurality of stud members affixed to an upper surface of said sole member projecting substantially vertically therefrom which are received in a plurality of stud member holes contained on said base plate member and being secured thereof by a plurality of fastener members.

11. A method of exercising using the hand-crawling apparatus of claim 8, where the pair of hand-crawling members include a first and a second hand-crawling member, where the first hand-crawling member has a first hand-embracing member and a first replaceable spring member and the second hand-crawling member has a second hand-embracing member and a second replaceable spring member, and said user commences undulating alternating upward and downward whippy locomotion therewith, comprising the steps of:

receiving one of said user's hands in said first hand-embracing member and said one of said user's hands being releasably secured thereto and receiving another one of said user's hands in said second hand-embracing member and said another one of said user's hands being releasably secured thereto, positioning a body of said user into a crawling posture with each of said first and second hand-crawling members and feet of said user being placed upon the ground; initiating leading forward locomotion with said first hand-embracing member being propelled upwardly by expansion of said first replaceable spring member, while simultaneously a weight of the user self-generates force downwardly thereby urging trailing forward locomotion with said second hand-embracing member imparting pressure thereupon thereby causing said second replaceable spring member to transition from being uncompressed to being compressed; continuing forward locomotion by disposing said first hand-crawling member and said second hand-crawling member in a diametrically opposite arrangement with said second hand-embracing member being propelled upwardly by expansion of said second replaceable spring member, while simultaneously the user's weight self-generates force downwardly thereby urging trailing forward locomotion with said first hand-embracing member imparting pressure on the first replaceable spring member thereby causing said first replaceable spring member to transition from being uncompressed to being compressed; and intermittently effectuating successive compression and decompression of said first replaceable spring member and said second replaceable spring member thereby enabling said whippy locomotion to be continued so long as said user engages said first and second hand-crawling members.

12. The hand-crawling apparatus recited in claim 1, wherein said external threads of said cylindrical post member has a pair of groove members laterally and symmetrically disposed thereupon.

13. The hand-crawling apparatus recited in claim 12, wherein said planar hand-platform member is rotated about said cylindrical post member to adjust a height thereof above said base assembly to be commensurate with said user's height attribute and then is securely engaged with one of said pair of groove members at an adjusted height with a fastener means disposed upon a ring member contiguous with and affixed to said cylindrical housing member.

14. The hand-crawling apparatus recited in claim 1, wherein said hand-embracing member comprises a front hand-embracing member disposed at a first end of said planar hand-platform member and affixed thereto, for embracing finger of a hand of the user and having a strap member for securing said fingers thereto.

15. The hand-crawling apparatus recited in claim 14, wherein said hand-embracing member comprises a rear hand-embracing member disposed at a second end of said planar hand-platform member, oppositely of said first end thereof, and attached to said hand-platform member, for embracing a heel and a wrist of said hand of said user and having a strap member for securing said heel and said wrist thereto, thereby preventing lateral movement thereof.

16. The hand-crawling apparatus recited in claim 1, wherein said planar hand-platform member comprises shock-absorption material selected from cork or gel to promote comfort and to avoid injury to a plethora of bones and concomitant ligaments and muscles constituting and proximal to hands of the user and similarly, to a back of said user.

17. The hand-crawling member recited in claim 1, wherein said replaceable spring member is inserted between said first retainer member and said second retainer member, and secured therebetween.

* * * * *